US005657681A

United States Patent [19]

Henricson

[11] Patent Number: 5,657,681

[45] Date of Patent: Aug. 19, 1997

[54] HYDRAULIC DRIVE SYSTEM

[76] Inventor: Ulf Henricson, Skolgatan 12, S-891 33 Örnsköldsvik, Sweden

[21] Appl. No.: 530,196

[22] PCT Filed: Mar. 29, 1994

[86] PCT No.: PCT/SE94/00284

§ 371 Date: Oct. 2, 1995

§ 102(e) Date: Oct. 2, 1995

[87] PCT Pub. No.: WO94/23198

PCT Pub. Date: Oct. 13, 1994

[30] Foreign Application Priority Data

Mar. 30, 1993 [SE] Sweden ..... 9301050

[51] Int. Cl.[6] ..... F01B 13/04

[52] U.S. Cl. ..... 91/472; 91/492; 92/182

[58] Field of Search ..... 91/472, 491, 492, 91/182; 92/61, 146

[56] References Cited

U.S. PATENT DOCUMENTS

| | | | |
|---|---|---|---|
| 3,439,551 | 4/1969 | Militana . | |
| 3,511,131 | 5/1970 | Kress | 91/472 |
| 4,066,002 | 1/1978 | Eastman | 91/492 |
| 4,503,751 | 3/1985 | Pinson | 91/491 |
| 5,101,925 | 4/1992 | Walker | 91/491 |

FOREIGN PATENT DOCUMENTS

| | | |
|---|---|---|
| 410887 | 11/1979 | Sweden . |
| 1151408 | 5/1969 | United Kingdom . |

*Primary Examiner*—Charles G. Freay
*Attorney, Agent, or Firm*—Young & Thompson

[57] ABSTRACT

The invention relates to a hydraulic drive system comprising a plurality of hydraulically driven piston units with cam rollers, which are disposed to act against a wave-shaped cam profile of a cam curve element, so that linear movement of the cam rollers against the cam profile produces a relative driving movement between the cam element and the piston units. The characterizing feature of the invention is that the drive system is composed of separate, assembled cam curve element modules and separate assembled piston units.

16 Claims, 3 Drawing Sheets

HYDRAULIC DRIVE SYSTEM

FIELD OF THE INVENTION

The present invention relates to a hydraulic drive system for operating primarily heavy industrial units of large dimensions, such as rotating mills, furnaces, drums, winches and the like or linearly moving conveyors, cranes, hoists and the like, comprising a plurality of hydraulically driven piston units with cam rollers, which are disposed to act against a wave-shaped cam profile of a cam curve element so that linear movement of the cam rollers against the cam profile produces a relative drive movement between the cam curve element and the piston units.

BACKGROUND OF THE INVENTION

Hydraulic rotational motors of cam ring type are previously known, comprising a fixed hub-like cylinder housing with a number of peripherally spaced radially oriented cylinders, in which cam roller supporting pistons, usually working diametrically in pairs, act with their radially guided cam rollers against a radially inwardly facing wave-shaped cam curve of a ring element surrounding the cylinder housing. As the piston moves outwards, the rollers are pressed against the cam curve and force it to rotate by virtue of the tangential force created. Characteristic of such hydraulic motors is that they can generate a very high constant torque over the entire rpm range from standing still up to maximum rpm. This type of hydraulic motor therefore has very good starting and low rpm performance without requiring any gears, at the same time as its design is relatively compact, simple and easy to service with the possibility of stepless rotational speed control.

By virtue of these advantageous features, hydraulic motors of cam ring type have found wide-spread application in the operation of relatively heavy industrial units, viz as motors for winches, apron conveyors, mills, drying drums and the like.

For operating units with very large dimensions, such as ore mills, drying ovens, barking drums and the like, today's hydraulic motors of cam ring type have, however, certain limitations.

SUMMARY OF THE INVENTION

A primary purpose of the present invention is to provide a hydraulic drive system operating according to the above described cam curve principle, which can be applied to operating units with very large external dimensions.

In its broadest concept, this purpose is achieved according to the present invention by virtue of the fact that the drive system is constructed of separate, assembled modules of cam curve elements and separate, assembled piston units, said modules of cam curve elements being mounted on the operating unit which is to be driven, and the piston units are mounted on a fixed frame, or vice versa. The proposed principle makes it possible to assemble components delivered as kit modules for the drive system of very large units.

A hydraulic motor of this type for rotation, can thus be used for very large operating units, such as mills or furnaces, the modules of the cam curve element having the shape of curved segments which are assembled into a ring or at least a portion of a ring around the periphery of the unit with the cam profile of the cam curve segments facing radially outwards, while the piston units are mounted in the frame along a circular arc radially outside the assembled curved cam curve segments.

The hydraulic drive system according to the invention can also be applied to linear driving of large work units, for transporting cranes, driving conveyors or the vertical driving of lifting means and jacks, with the modules of cam curve elements being straight and the piston units being mounted along a straight line parallel to the cam curve element.

In principle there is no upper limit as to how large the hydraulic drive system according to the invention can be made.

BRIEF DESCRIPTION OF THE DRAWINGS

Further details of the drive system according to the invention will be described in more detail below with reference to the accompanying drawings, where.

DETAILED DESCRIPTION OF THE PREFERRED EMBODIMENTS

Figure 1:
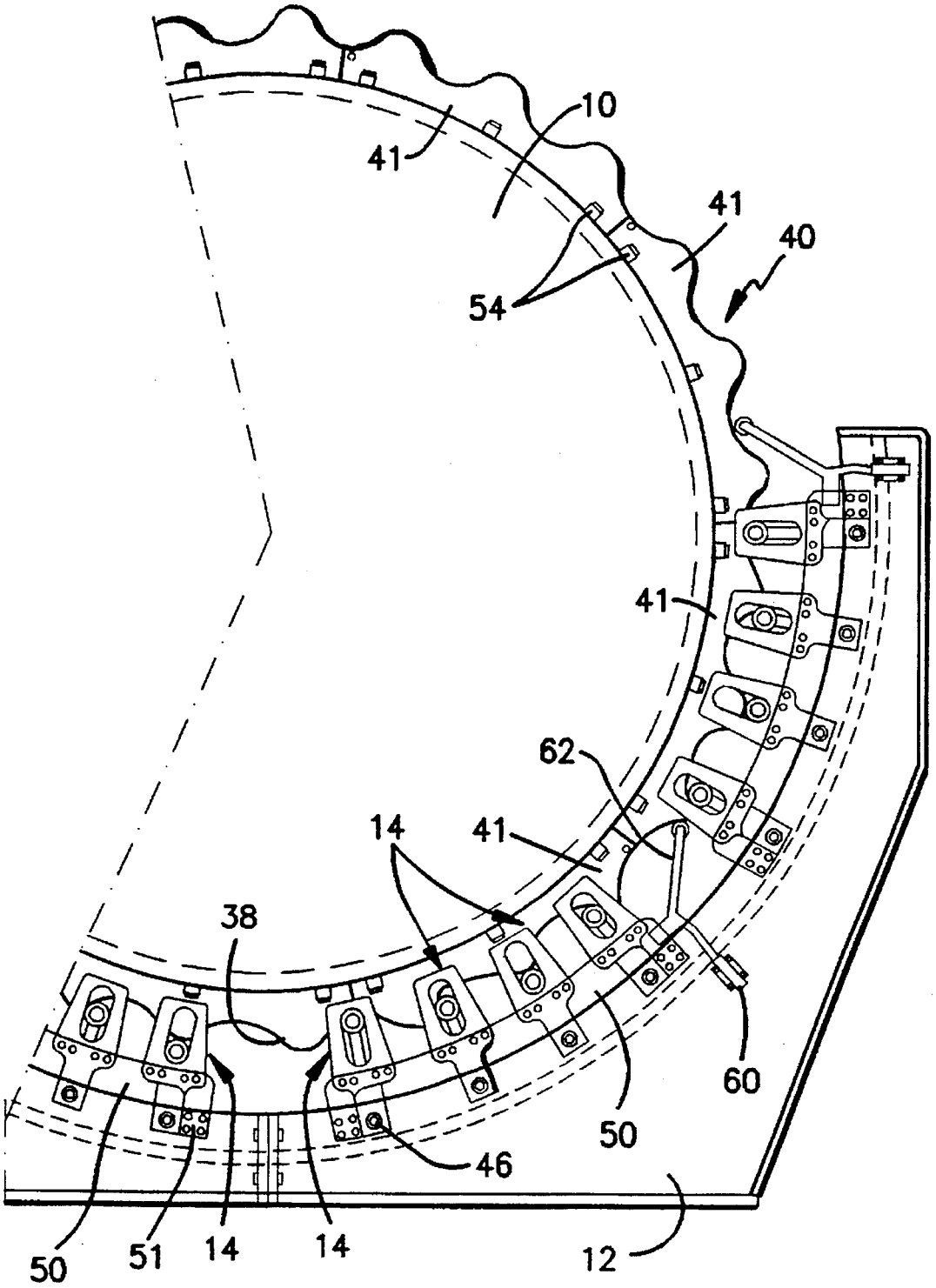
FIG. 1 shows an end view of a drum rotating about a horizontal axis, driven by a hydraulic drive system according to the invention, where only the righthand half and a portion of the lefthand half are shown of the drum end drive system.

FIG. 1 shows a conceivable application of a hydraulic drive system according to the present invention, viz a drive system for rotation of a cylindrical drum 10 of very large diameter and with a horizontal longitudinal axis. The drum 10 can be rotatably mounted in bearings (not shown) located at longitudinally spaced locations along the drum.

In the embodiment shown, the hydraulic drive system comprises a fixed U-shaped frame 12, which surrounds a portion of the circumference of the drum 10, specifically the lower half of the circumference. It should be pointed out that the lefthand portion of the drum (shown only partially in FIG. 1) with drive system is identical to the righthand half. If so desired, the frame with its piston units described below can enclose the entire circumference of the drum 10.

Figure 3:
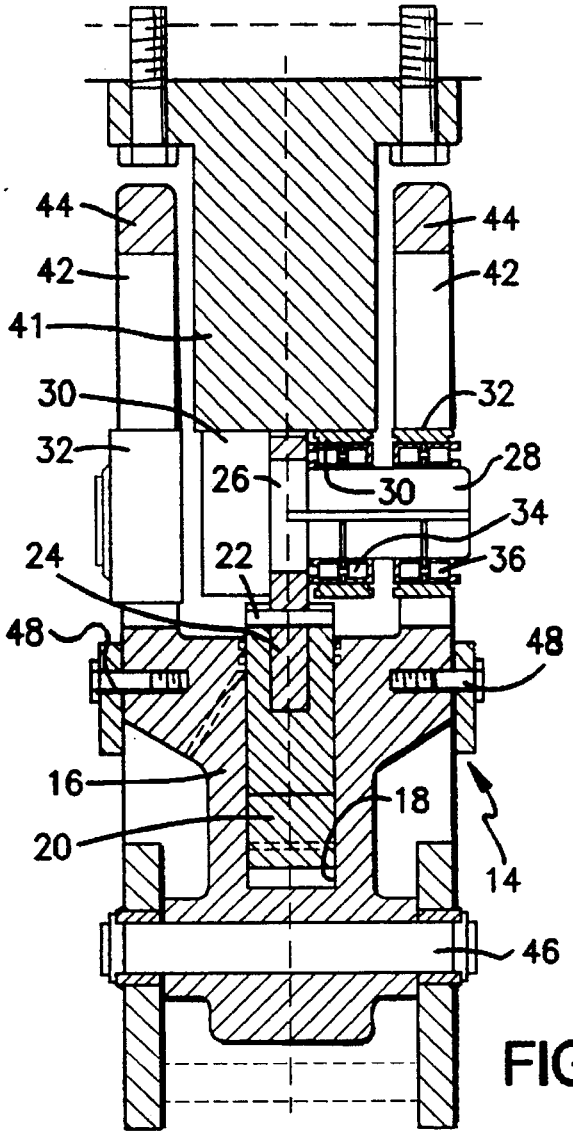
FIG. 3 is a cross section through one of the piston units and the associated cam curve element.
Figure 2:
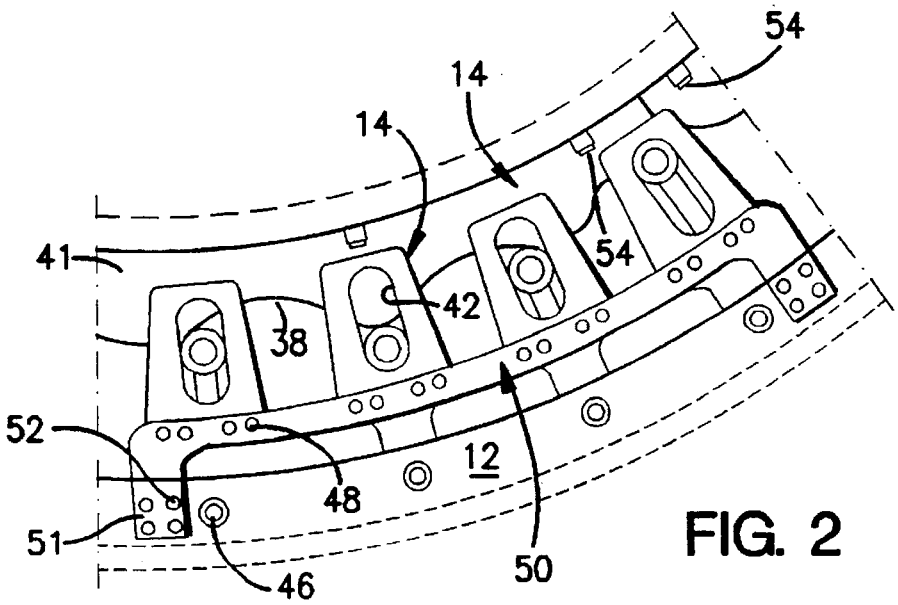
FIG. 2 shows on a larger scale a group of four separate piston units.

The frame 12 supports four groups, each of four radially oriented piston units 24. As shown in more detail in FIG. 3, each piston unit 14 comprises a body 16 in which there is a cylindrical hole 18 for a hydraulically actuated piston 20. The piston 20 is joined by means of a pin 22 to a piston rod 24, the end of which remote from the piston 20 surrounds and holds a central portion 26 of a transverse bearing shaft 28. On the other side of the central portion 26 the bearing shaft 28 supports a pair of cam rollers 30 on bearings 34, and a pair of guide rollers 32 on bearings 36. The cam rollers 30 are arranged to roll against a wave-shaped cam profile 38 of an annular cam curve element 40 mounted about the outer periphery of the drum 10, while the guide rollers 32 run in radially oriented guide grooves 42 in a pair of parallel spaced lateral legs 44 of the body 16, straddling the cam curve element 40. Each piston unit 14 is securely mounted in the frame 12 by means of a pin 46 and by means of screws 48 in a torque absorbing arm 50 on either side of the four piston units 14 in each group. As is shown in FIG. 2, the torque absorbing arms 50 are in turn fixed at their ends 51 to the frame 12 by means of bolts 52.

Figure 4:
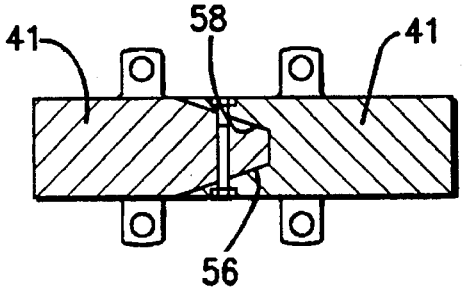
FIG. 4 is a section along the line VI—VI in FIG. 1, taken at a joint between two cam curve segments.

As is best shown in FIG. 1, the cam element 40, with which the cam rollers 30 are to interact during the rotational driving of the drum 10, is made up of a number of curved cam curve segments 41 which are fixed to the drum 10 by means of screws 54. The joint between the cam segments.41 can be made as shown in FIG. 4, where a wedge-shaped end portion 56 engages in a corresponding wedge-shaped cavity 58 in the opposite end portion of the adjacent cam segment, which provides a smooth transition as regards surface pressure for the cam rollers 30 when passing the joint between two adjacent cam segments 41. The wave-shaped cam profile 38 of each cam segment 41 has in the embodiment shown three lobes, and the joint between the curve segments 41 is placed in a valley portion between the cam segments. Each cam segment can also consist of individual lobe units which are welded together into a ring.

The operating principle of the hydraulic drive system according to the invention corresponds to the operating principle for a known so-called "four piston machine", which means that the number of pistons is evenly divisible by four, while the number of cam tops is evenly divisible by three. In the embodiment shown in FIG. 1, the cam ring 40 is composed of nine cam curve segments 41, each with three cam tops, i.e. a total of twentyseven, while the number of piston units 16 is four times four, i.e. sixteen. The piston units 16 are arranged in a manner known per se to cooperate with the cam curve 38 of the cam ring 40 so that at synchronized, phased strokes of the pistons 20 and the associated cam rollers 30 in the different groups of piston units 14 there is achieved a linear relationship between the fluid pressure in the piston units and the imparted torque on the cam ring 40 or between the fluid flow to the piston units and the rpm of the drum 10.

In order to direct the flow of hydraulic fluid to the respective piston unit 14, a valve 60 can be associated with each pair of piston units 14, said valve, in the example shown being controlled by a cam follower 62 which is in contact with the cam curve profile 38. In FIG. 1, only one valve 60 and cam follower 62 are shown for each group of four piston units 14. A corresponding valve (not shown) is disposed on the other side of the frame 12. This valve function can also be built into the respective piston unit 14 or be performed by electrically controlled valves.

Figure 5:
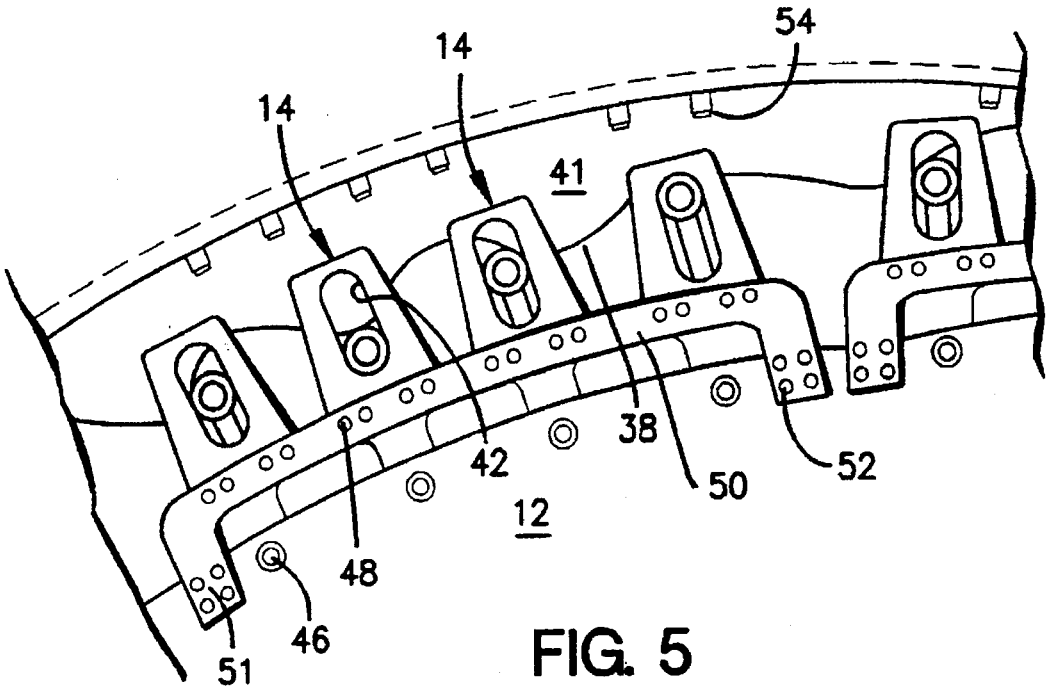
FIG. 5 shows an end view of a drum rotating about a horizontal axis, driven by a hydraulic drive system with the piston units mounted on the rotating drum.
Figure 6:
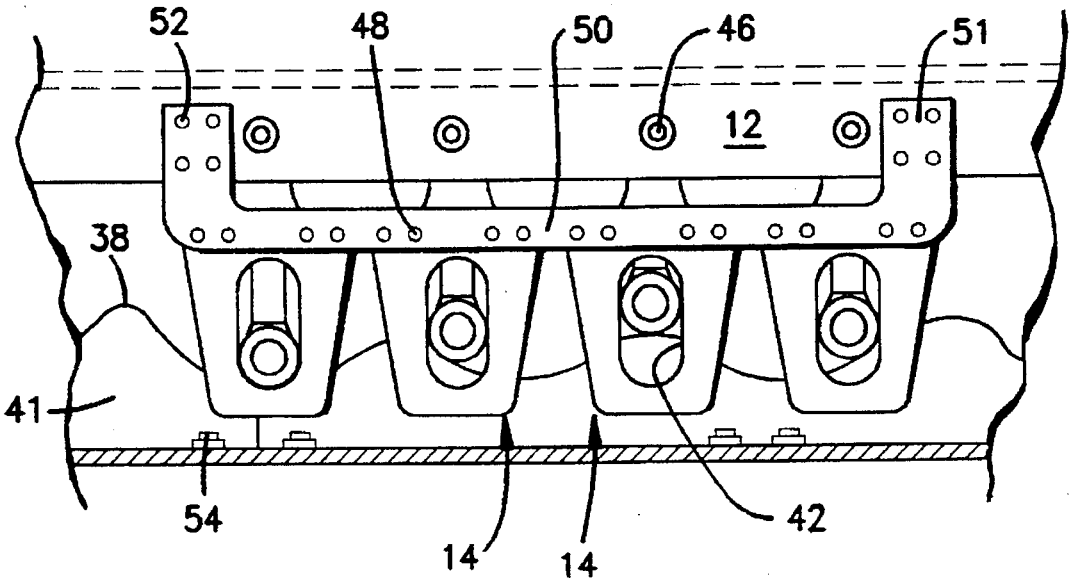
FIG. 6 shows a view of the invention embodied as a hydraulic linear drive.

In FIG. 1–4, a drive system according to the invention has been exemplified in the form of a large rotating drum 10 with a cam profile 38 of the cam curve element 40 which is directed radially outwards relative to the center of the drum. Within the scope of the invention it is, however, conceivable to have the reverse arrangement, i.e. that the piston units 14 are mounted on the movable rotating portion while the cam curve element is mounted on the fixed frame portion, as illustrated in FIG. 6. It is also conceivable for certain applications to make the cam element and the piston units as linearly extended components, e.g. in cranes, hoists, conveyors and the like, where the piston units are mounted on the moving working portion and the straight cam curve segments on a fixed supporting surface as illustrated in FIG. 5, or vice versa.

I claim:

1. A hydraulic system for operating a heavy duty industrial working unit comprising:

a plurality of hydraulically-driven piston units with cam rollers, which are disposed to act against a wave-shaped cam profile of a cam curve element so that a linear movement of the cam rollers against the cam profile produces a relative drive movement between the cam curve element and the piston units;

said drive system being constructed of individual modules of cam curve elements mounted on a fixed support; and individual piston units being mounted on the working unit.

2. A hydraulic drive system according to claim 1, for rotational driving of the working unit, wherein said modules of cam curve elements have a shape of curved segments assembled to form at least a portion of a cam ring around a periphery of the working unit.

3. A hydraulic drive system according to claim 2, wherein said cam profile of the cam curve segments faces radially inwards and said piston units are mounted along a circular arc radially inside the assembled cam curve segments.

4. A hydraulic drive system according to claim 1, for linear driving of the working unit, wherein said modules of cam curve elements are straight and said pistons are mounted along a straight line parallel to the cam curve element.

5. A hydraulic drive system according to claim 1, wherein each piston unit comprises a body with at least one cylindrical hole, in which a hydraulically actuated piston is displaceably mounted, a distal end of said piston supporting a cam roller means for making contact with the cam profile of the cam curve element, said body and said cam roller means having cooperating guide means for guiding the cam roller means in a movement perpendicular to a longitudinal axis of symmetry of the cam curve element as the piston reciprocates in its cylinder.

6. A hydraulic drive system according to claim 5, wherein a number of separate piston units are arranged in individual groups on the support.

7. A hydraulic drive system according to claim 6, wherein said piston units in each group are controlled in sequence and in synchrony with corresponding piston units in other groups of piston units acting on the cam curve element, said cam curve element comprising assembled cam curve modules.

8. A hydraulic drive system for operating a heavy duty industrial working unit comprising:

a plurality of hydraulically driven piston units with cam rollers, which are disposed to act against a wave-shaped cam profile of a cam curve element so that a linear movement of the cam rollers against the cam profile produces a relative drive movement between the cam curve element and the piston units;

said drive system being constructed of individual modules of cam curve elements mounted on the working unit; and individual piston units mounted on a fixed support.

9. A hydraulic drive system according to claim 8, for rotational driving of the working unit, wherein said modules of cam curve elements have a shape of curved segments assembled to form at least a portion of a cam ring around a periphery of the working unit.

10. A hydraulic drive system according to claim 9, wherein said cam profile of the cam curve segments faces radially outwards and said piston units are mounted along a circular arc radially outside the assembled curved cam curve segments.

11. A hydraulic drive system according to claim 8, for linear driving of the working unit, wherein said modules of cam curve elements are straight and said piston units are mounted along a straight line parallel to the cam curve element.

12. A hydraulic drive system according to claim 8, wherein each piston comprises a body with at least one cylindrical hole, in which a hydraulically actuated piston is displaceably mounted, a distal end of said piston supporting a cam roller means for making contact with the cam profile of the cam curve element, said body and said cam roller means having cooperating guide means for guiding the cam roller means in a movement perpendicular to a longitudinal axis of symmetry of the cam curve element as the piston reciprocates in its cylinder.

13. A hydraulic drive system according to claim 12, wherein a number of separate piston units are arranged in individual groups on the support.

14. A hydraulic drive system according to claim 13, wherein said piston units in each group are controlled in sequence and in synchrony with corresponding piston units in other groups of piston units acting on the cam curve element, said cam curve element comprising assembled cam curve modules.

15. A hydraulic drive system according to claim 9, for rotation of a heavy duty tubular working unit with a horizontal axis of rotation, wherein said cam ring comprising a plurality of cam curve segments with an outwardly facing profile, is mounted on the periphery of the tubular working units, said support at least partially enclosing a circumference of the cam ring.

16. A hydraulic drive system according to claim 13, wherein a supply of hydraulic medium to the piston units in each group is controlled by a cam controlled valve means.

* * * * *